US005222292A

United States Patent [19]

Comerci et al.

[11] Patent Number: 5,222,292

[45] Date of Patent: Jun. 29, 1993

[54] HAND TOOL FOR APPLYING ELECTRICAL CONNECTORS

[75] Inventors: Joseph D. Comerci, Elmhurst; Robert DeRoss, Naperville; Robert E. Erklin, Sr., Bedford Park; Frederick J. Gierut, Tinley Park, all of Ill.

[73] Assignee: Molex Incorporated, Lisle, Ill.

[21] Appl. No.: 819,415

[22] Filed: Jan. 10, 1992

[51] Int. Cl.[5] ..... H01B 43/00

[52] U.S. Cl. ..... 29/749; 29/751; 29/758; 29/257

[58] Field of Search ..... 29/749, 751, 753, 758, 29/257

[56] References Cited

U.S. PATENT DOCUMENTS

| | | | |
|---|---|---|---|
| 3,237,291 | 3/1966 | Kelso | 29/257 |
| 4,349,944 | 9/1982 | Fickes | 29/749 X |
| 4,386,461 | 6/1983 | Plummer | 29/749 |
| 4,481,710 | 11/1984 | Caveney et al. | 29/749 |
| 4,542,583 | 9/1985 | Anderson | 29/749 |
| 4,741,099 | 4/1988 | Olsson | 29/749 |

*Primary Examiner*—Carl E. Hall

*Attorney, Agent, or Firm*—Stephen Z. Weiss

[57] ABSTRACT

A portable hand tool is provided for applying at least a two-part electrical connector having insulation displacement conductive elements to an insulated electrical cable. The tool includes a manually grippable frame, with a loading die on the frame for receiving and holding the two-part electrical connector in spaced relationship. A compression die is movable relative to the loading die into pressure engagement with the electrical connector. A shaft is threaded through the frame and is connected to the compression die to effect movement of the compression die relative to the loading die in response to rotation of the shaft. A manually grippable torque applying handle projects outwardly of the shaft for rotating the shaft. A second manually grippable handle is retractably mounted on the frame for projecting outwardly therefrom and for retraction to an inoperative position alongside the frame.

14 Claims, 1 Drawing Sheet

HAND TOOL FOR APPLYING ELECTRICAL CONNECTORS

FIELD OF THE INVENTION

This invention generally relates to the art of electrical connectors and, particularly, to a portable hand tool for applying or terminating a multi-component electrical connector.

BACKGROUND OF THE INVENTION

There are a wide variety of hand tools available for performing various operations on electrical connectors to effect termination of terminals in the connectors with electrical cables such as insulated electrical cables wherein the terminals effect an insulation displacement type termination.

One of the most common types of hand tools of the character described is of a pliers-type tool for effecting a scissors-type motion between a pair of pivotally connected handles. A problem with such pliers-type tools is that they either operate with their closing jaws or dies moving in arcuate paths versus linear paths or complicated toggle arrangements are used and which require numerous parts to convert the arcuate movement of the scissors-type handles to linear movement of the jaws. Other non-pliers type hand tools are available but those tools, again, employ an excess number of parts, are excessively bulky and are not easily handled.

There is a need for a simple, portable hand tool for applying a two-part electrical connector, the jaws or dies of the tool operating in a linear path, and which is simple to operate and/or manipulate. An example of such a need is in the area of terminating or applying flat ribbon cable which include a plurality of individually insulated electrically conductive wires attached to one another substantially in a plane through the use of an insulating web, such as of plastic material. In terminating such ribbon cable, a hand tool must apply uniform linear forces between opposing jaws or dies of the tool because of the substantial planar area of the cable to be terminated, i.e. in comparison to terminating a single or discrete wire. Of course, the invention is applicable to a variety of electrical cables wherein the advantages of the invention are of significance.

SUMMARY OF THE INVENTION

An object, therefore, of the invention is to provide a new and improved portable hand tool for applying at least a two-part electrical connector having insulation displacement conductive elements to an insulated electrical cable.

In the exemplary embodiment of the invention, the hand tool includes a manually grippable frame. A loading die is mounted on the frame for receiving and holding the two-part electrical connector in spaced relationship. A compression die is movable relative to the loading die into pressure engagement with the electrical connector. Generally, pressure applying means are operatively associated between the frame and the compression die for effecting movement of the compression die relative to the loading die, whereupon pressure is exerted on the electrical connector.

Specifically, the invention contemplates that the pressure applying means include a shaft threaded through the frame and connected to the compression die to effect the movement thereof in response to rotation of the shaft. Torque applying means are provided for rotating the shaft. In the illustrated embodiment of the invention, the torque applying means include a manually grippable handle projecting radially of the shaft. In addition, the torque applying means may include a head on a distal end of the shaft and adapted to accept a wrench device or the bit of a power tool.

A feature of the invention is the provision of lock means operatively associated with the shaft to limit axial movement of the shaft to thereby prevent excess pressure from being applied to the electrical connector. In the preferred embodiment of the invention, the lock means is provided by a lock ring or nut-type device threaded onto the shaft and abuttable with the frame. The lock ring, thereby, is adjustable along the shaft to vary the axially limit position of the shaft.

Another feature of the invention is the provision of a manually grippable handle retractably mounted on the frame. In the preferred embodiment of the invention, the manually grippable handle is movably mounted on the frame for movement between an inoperative position alongside the frame and a grippable position projecting outwardly from the frame, such as providing the handle in the form of a lever arm pivotally mounted on the frame. As disclosed herein, a recess is provided on the outside of the frame and within which the retractable handle is positionable in its inoperative position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DETAILED DESCRIPTION OF THE PREFERRED EMBODIMENT

Figure 1:
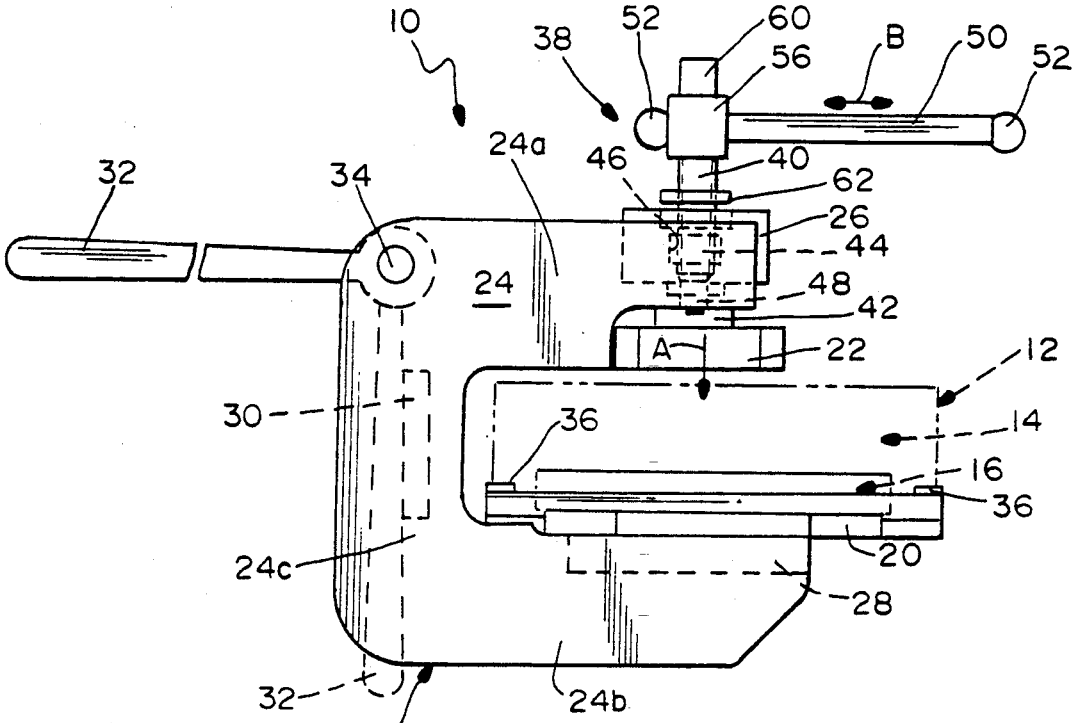
FIG. 1 is a side elevational view of a portable hand tool embodying the concepts of the invention.

Referring to the drawings in greater detail, the invention is disclosed in a portable hand tool generally designated 10, for applying at least a two-part electrical connector shown in phantom and generally designated 12. The connector does not comprise part of the invention and can be of a variety of configurations. For instance, a first part, generally designated 14, of the connector may comprise an insulated housing having a plurality of insulation displacement conductive elements, such as insulation-piercing terminals, mounted therein. A second part, generally designated 16, may be provided in the form of a cover or cable clamping device for gripping or clamping a flat ribbon cable. As is known, a ribbon cable consists of a plurality of individually insulated electrically conductive wires attached to one another substantially in a plane through the use of a web of insulation, such as of plastic.

The two-part electrical connector 12, including housing part 14 and cable clamping part 16, are positioned in tool 10, as described below, in a spaced relationship. The housing and the cable clamping device then are compressed to drive the terminating portions of the insulation-piercing terminals (within housing 14) into terminating engagement with the insulated wires of the ribbon cable. Of course, it should be understood that the general concepts and features of the invention in portable hand tool 10 should not be limited specifically to any type of cable.

Hand tool 10 includes a manually grippable frame, generally designated 18, a loading die 20 and a compression die 22 movable relative to the loading die into pressure engagement with electrical connector 12.

More particularly, frame 18 includes a pair of side plates 24 interconnected by three spacer/mounting blocks 26, 28 and 30. Each side plate 24 is generally U-shaped, as seen in FIG. 1, and includes an upper leg portion 24*a*, a lower leg portion 24*b* and a bight portion 24*c* joining the leg portions. Block 26 is disposed between the upper leg portions 24*a* of side plates 24, block 28 is disposed between lower legs 24*b* of the side plates and block 30 is disposed between bight portions 24*c* of the side plates, to provide a rigidifying framed structure. The blocks may be secured to the inside of the U-shaped side plates by any appropriate fastening means, such as adhesives, welds, mechanical fasteners or the like.

A feature of the invention is the provision of a manually grippable handle 32 (FIG. 1) which is retractably mounted on frame 18, as by pivoting the handle at 34 between side plates 24. The handle thereby acts as a lever arm which is movably mounted on the frame for movement between an inoperative position, alongside the frame as shown in dotted lines in FIG. 1, and a grippable position projecting outwardly from the frame, as shown in full lines in FIG. 1. Side plates 24 and spacer/mounting block 30 define a recessed area within one side of the frame for positioning handle 32 in its inoperative position.

Figure 2:
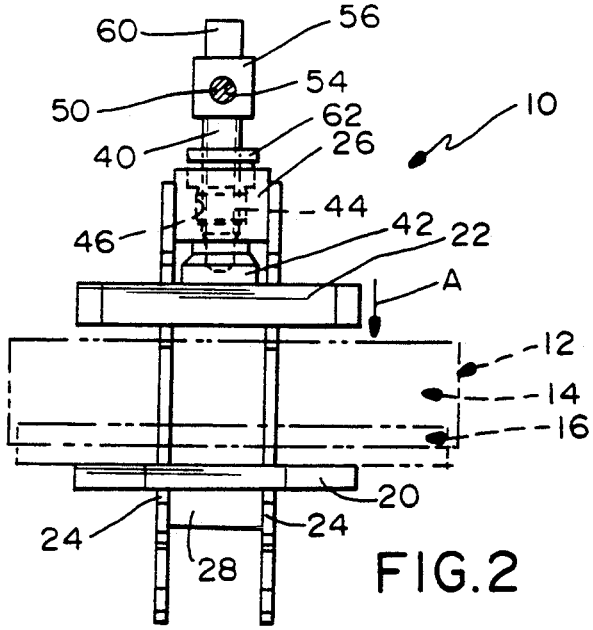
FIG. 2 is a front elevational view of the hand tool.

Loading die 20 of hand tool 10 is fixed to frame 18 for receiving and holding connector 12. The loading die is in the form of a platform which has a significant width (as seen in the front view of FIG. 2) and a significant depth (as seen in the side view of FIG. 1) to provide a significant supporting surface area in relation to the size of connector 12 which, as described above, may be employed to terminate a flat ribbon cable of significant width. If the connector is used as a tap connector, the ribbon cable would run through the connector in a left-to-right direction as viewed in FIG. 2. The platform-like loading die 20 may include upstanding posts or flanges 36 for engaging the sides or corners of connector 12 to properly hold the connector laterally or horizontally on the loading die.

As stated above, compression die 22 is movable relative to loading die 20 into pressure engagement with the electrical connector, as in the direction of arrows "A", as the loading die is fixed and acts as an anvil opposing the movable compression die. Generally, pressure applying means, generally designated 38, are operatively associated between frame 18 and compression die 22 for effecting movement of the compression die relative to loading die 20, whereupon pressure is exerted on the electrical connector in the direction of arrows "A". The compression die has a shape which provides the tool operator with access to the two part electrical connector whereby the operator may apply fasteners to the connector which can hold it together in the compressed state.

More particularly, pressure applying means 38 include a shaft 40 threaded through the frame and connected at its lower distal end to compression die 22, as by a connecting bracket 42. The shaft is threaded through the frame by means of a bronze bushing 44 which is threaded into the frame in tap 46 through upper frame block, 26. In assembly, bushing 44 would be screwed into tap 46, and a set screw 47 locks the bushing preventing movement with the frame. The shaft extends downwardly and freely through washer 62 which is free to move about the axis of the shaft and then through an appropriately sized bore in block 26. The shaft then is threaded through bushing 44, and a distal end 48 of the shaft is secured within bracket 42 which is fixed to the top of compression die 22. Therefore, rotation of shaft 40, with bushing 44 captured against rotation within tap 46, effects vertical linear movement of the shaft and corresponding linear movement of compression die 22 relative to fixed loading die 20 and a positioned electrical connector 12.

Generally, torque applying means are provided for rotating shaft 40. More particularly, a manually grippable handle 50, having knobs 52 at opposite ends thereof, projects outwardly from shaft 40 for gripping by an operator. The handle may project through a horizontal hole 54 (FIG. 2) in a block portion 56 which is formed integral with an upper area of the shaft. The handle may be movable freely within hole 54, in the direction of double-headed arrow "B" (FIG. 1). Therefore, the handle can project away from either side of shaft 40 for the convenience of an operator, or the handle can be located within block 56 intermediate the ends of the handle for gripping on both sides of the shaft as desired by the operator. Of course, knobs 52 prevent the shaft from moving completely out of block 56. Additional torque applying means may be provided in the form of a head 60 on the upper distal end of shaft 40 and appropriately configured for accepting a wrench device or the bit of a power drill.

Lastly, another feature of the invention, generally, is the provision of lock means associated with shaft 40 to limit axial movement thereof to thereby prevent excess pressure from being applied to electrical connector 12. More particularly, the lock means includes a flange 63 located under handle block 56, washer 62, and bushing 44 tapped to block 26 into which shaft 40 is threaded. When shaft 40 moves axially downward in response to rotational movement of the shaft, flange 63 will move axially therewith and abut washer 62 which will abut the upper portion of bushing 44 to prevent further axial movement of the shaft. With the bushing being threaded into the block 26, it can be understood that the bushing is adjustable to vary the axial limit position of the shaft to accommodate varying sizes of electrical connectors. Set screw 47 may be provided to prevent unintentional movement of the bushing 44 away from its set position.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A portable hand tool for applying at least a two-part electrical connector having insulation displacement conductive elements to an insulated electrical cable, comprising:

a manually grippable frame;

a loading die on the frame for receiving and holding the two-part electrical connector in spaced relationship;

a compression die movable relative to the loading die into pressure engagement with the electrical connector; and pressure applying means operatively associated between the frame and the compression die for effecting movement of the compression die relative to the loading die, whereupon pressure is exerted on the electrical connector; and wherein the improvement comprises said pressure applying means including a shaft threaded through the frame and connected to the compression die to effect said movement thereof in response to rotation of the shaft, first torque applying means for rotating the shaft and adjustable lock means threaded into the frame and operatively associated with the shaft to limit axial movement thereof to thereby prevent excess pressure from being applied to the electrical connector.

2. The portable hand tool of claim 1 wherein said first torque applying means include a first manually grippable handle on the shaft.

3. The portable hand tool of claim 1, wherein said first torque applying means include a head on a distal end of the shaft adapted to accept a wrench device.

4. The portable hand tool of claim 3 wherein said lock means includes:

a bushing, threaded into the frame, having an internal thread adaptable to receive the threaded shaft and an upper portion directed opposite the compression die, bushing in relation to the frame, a flange on an end of the shaft opposite the compression die, and a washer through which said shaft passes which abut both the upper portion of said bushing and the flange on said shaft.

5. The portable hand tool of claim 1 including a second manually grippable handle retractably mounted to the frame for movement between an inoperative position alongside the frame and a grippable position projecting outwardly from the frame for applying, when in said grippable position, torque to the tool opposite that applied by said first torque applying means.

6. The portable hand tool of claim 5 wherein said frame includes a recess on the outside thereof and within which said handle is positionable in its inoperative position.

7. The portable hand tool of claim 5 wherein said second handle is in the form of a lever arm pivotally mounted on the frame.

8. The portable hand tool of claim 1 wherein said first torque applying means include a first manually grippable handle projecting outwardly of the shaft, and including a second manually grippable handle projecting outwardly of the frame, said second manually grippable handle adapted to apply a torque to the tool opposite that applied by said first torque applying means.

9. The portable hand tool of claim 8 wherein said second manually grippable handle is movably mounted on the frame for movement between a retracted position alongside the frame and a grippable position projecting outwardly from the frame.

10. The portable hand tool of claim 1 wherein said frame is generally U-shaped, with the loading die being located inside one leg of the U-shaped frame and the compression die and pressure applying means being operatively associated with the other leg of the U-shaped frame.

11. The portable hand tool of claim 10, including a manually grippable handle mounted on a bight portion of the U-shaped frame.

12. The portable hand tool of claim 11, wherein said manually grippable handle is movably mounted on the frame for movement between an inoperative position alongside the frame and a grippable position projecting outwardly from the frame.

13. The portable hand tool of claim 12 wherein said frame includes a recess on the outside thereof and within which said handle is positionable in its inoperative position.

14. The portable hand tool of claim 12 wherein said handle is in the form of a lever arm pivotally mounted on the frame.

* * * * *